United States Patent [19]

Yanagida et al.

[11] 4,327,466

[45] May 4, 1982

[54] CONDITIONING MACHINE FOR BRUSHING END FACE OF METAL MATERIAL

[75] Inventors: Yoshitsugu Yanagida, Aichi; Mitsuo Higuchi, Yokosukamachi; Yoshiaki Ito, Aichi; Shigeru Nakaji; Syogo Ehiro, both of Okayama, all of Japan

[73] Assignees: Kawasaki Steel Corporation, Hyogo; Aichi Steel Works, Limited, Aichi, both of Japan

[21] Appl. No.: 136,915

[22] Filed: Apr. 3, 1980

[30] Foreign Application Priority Data

Sep. 7, 1979 [JP] Japan ..... 54-115010

[51] Int. Cl.[3] ..... B21C 37/30; B24B 7/00; A47L 15/00

[52] U.S. Cl. ..... 29/90 R; 15/77; 51/124 R; 51/125

[58] Field of Search ..... 29/90 R; 51/124 R, 125, 51/126; 15/77, 88, 21 R

[56] References Cited

U.S. PATENT DOCUMENTS

| | | | |
|---|---|---|---|
| 147,536 | 2/1874 | Whitney | 29/90 R X |
| 833,787 | 10/1906 | Johnston | 29/90 R X |
| 1,106,803 | 8/1914 | Grant | 15/88 X |
| 2,294,047 | 8/1942 | Pollock | 51/124 R X |
| 2,680,938 | 6/1954 | Peterson | 29/90 R |
| 2,948,087 | 8/1960 | Caton | 15/77 X |
| 3,708,817 | 1/1973 | Rhine et al. | 15/77 |
| 3,888,049 | 6/1975 | MacSween | 51/126 X |
| 3,992,823 | 11/1976 | Pachmayr et al. | 51/124 R |
| 4,257,195 | 3/1981 | Appelgren | 51/124 R |

*Primary Examiner*—Harrison L. Hinson
*Attorney, Agent, or Firm*—Koda and Androlia

[57] ABSTRACT

According to the present invention, a brushing mechanism for brushing an end face of a metal material to be brushed and an angle detector for detecting an inclination of the end face of a metal material to be brushed are rested on a frame mechanism, said frame mechanism is provided in such a manner as to be swingable or fixable with respect to a base, a side surface of said angle detector in parallel to a brushing surface of said brushing mechanism is moved into a space formed between the end face to be brushed and the brushing surface of said brushing mechanism and brought into abutting contact with the face to be brushed, and the frame mechanism is swinged and inclined commensurate to the inclination of the end face to be brushed by the abutment of said angle detector against the face to be brushed, whereby the brushing surface of said brushing mechanism is brought into parallel to the end face to be brushed, so that the brushing of the end face to be brushed by said brushing mechanism can be effected in parallel to the end face to be brushed.

6 Claims, 12 Drawing Figures

CONDITIONING MACHINE FOR BRUSHING END FACE OF METAL MATERIAL

BACKGROUND OF THE INVENTION

1. Field of the Invention

This invention relates to a conditioning machine for brushing an end face of metal material, and particularly to a conditioning machine for brushing an end face of a metal material, suitable for removing burrs produced on the end surface of metal material when a metal material such as various kinds of shaped steel bars is cut, said various kinds of shaped steel bars including I shaped steel bars, H shaped steel bars, sheet-piling steel bars, square bars, rail, rod, pipe. (Here, brushing includes the operation such as cutting, grinding and polishing).

2. Description of the Prior Art

In general, when a metal material such as a shaped steel bar produced in an iron work is cut by means of a saw, adhered pieces called burrs are frequently formed at ridge portions of an end face thus cut. Said burrs are removed manually or by means of a brushing machine because they tend to form obstacles for transporting and handling during working process and have dangers of giving damages to the workers handling the metal material.

Now, when a shaped steel bar is cut, the cut surface generally tends to be inclined but not normal to the direction of the shaped steel bar, and variations are found in the value of inclination. In the case the removal of burrs from such a shaped steel bar as described above by means of a conventional brushing machine, as shown in FIGS. 1A to 1C, no matter whether the end face 2 of a sheet pile 1 to be brushed perpendicularly to the longitudinal direction of the sheet pile 1 or inclined thereto, a portion 3 to be brushed covered by crossed lines in the drawing is brushed in a manner to brush the end face perpendicular to the longitudinal direction of the sheet pile 1.

Then, in the case the end face 2 of the sheet pile 1 to be brushed is inclined as shown in FIG. 1B or 1C, ununiform wear may be caused to brushing tools such as a grind stone and a wire brush or brushes, a considerable adverse influence is exerted to the service life of the brushing mechanism, and the workmanship of the end face 2 of the sheet pile 1 to be brushed will not satisfactory. Furthermore, in the case variations in inclination are found with the end faces 2 of the metal material to be brushed, if the cut-in values are adjusted from one to another starting from the further projecting portion commensurate to the values of inclination of the metal materials so as to brush the end face perpendicular to the longitudinal direction of the sheet pile 1, then such end faces thus brushed cannot be quickly obtained, thereby decreasing the brushing efficiency. Furthermore, when variations in inclination are found with the end faces 2 of the sheet pile 1 to be brushed, the cut-in value is predetermined commensurate to said largest value of inclination (the length of the portion covered by crossed lines in FIG. 1B, e.g., 5 mm) from among all of those inclinations so that, even with the end face 2 to be brushed having the largest inclination, an end face perpendicular to the longitudinal direction of the sheet pile 1 can be obtained. Even if the end face 2 to be brushed is perpendicular to the longitudinal direction of the sheet pile 1(in spite of the fact that, in this case, with lesser cut-in value than the cases of the materials shown in FIGS. 1B and 1C which have been inclinedly cut in their edges, e.g., 2 mm, burrs can be removed from ridge portions of the end face 2 of the sheet pile 1 to be brushed), said largest value of inclination is brushed away as the perdetermined cut-in value. Hence, there have been raised such problems that the yield of the sheet pile 1, in which the end faces perpendicular to the longitudinal direction of the metal materials are thus obtained, is decreased, the service life of the brushing mechanism is reduced to a considerable extent, and further, the driving force required for the brushing mechanism is increased.

If otherwise, manual operation by use of a hand grinder would result in low efficiency in operation and low productivity to an extreme extent.

SUMMARY OF THE INVENTION

This invention has been developed to obviate the above described problems of the prior art, and has as its object the provision of a conditioning machine for brushing an end face of a metal material to be brushed, wherein the workmanship of the end face of a steel to be brush is satisfactory, no adverse influence is exerted to the service life and the like of a brushing mechanism, and further, a mechanism for bringing the brushing mechanism in parallel to the end faces to be brushed is smoothly operated.

To accomplish the abovedescribed object, the conditioning machine for brushing the end face of a metal material to be brushed accordingly to the present invention comprises:

a brushing mechanism having a brushing tool for brushing the end face of a metal material to be brushed;

an angle detecting mechanism having a side surface in parallel to a brushing surface of the brushing tool of said brushing mechanism, provided in such a manner as to be movable into and out of a space formed between the end face of a metal material to be brushed and the brushing surface of the brushing tool of the brushing mechanism, and being capable of abutting against the end face of a metal material to be brushed to detect an inclination of the end face to be brushed;

a frame mechanism having rested thereon said brushing mechanism and said angle detecting mechanism, being swingable with respect to a base, and being linearly movable with respect to the end face of a metal material to be brushed; and a copying mechanism for causing said frame mechanism to follow the inclination of the end face to be brushed and be swinged, when said angle detecting mechanism abuts against the end face to be brushed, whereby the brushing surface of the brushing tool of the brushing mechanism is brought into parallel to the end face of the metal material to be brushed.

BRIEF DESCRIPTION OF THE DRAWINGS

The abovementioned features and object of the invention will become more apparent with reference to the following description, taken in conjunction with the accompanying drawings, wherein like reference numerals denote like elements, and in which.

DETAILED DESCRIPTION OF THE INVENTION

Description will hereunder be given of an embodiment of the present invention with reference to the drawings.

Figure 1A:
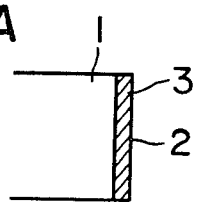
FIGS. 1A, 1B and 1C are explanatory view showing the results of brushing the end faces of a metal material by use of the conventional brushing machine, respectively.
Figure 1B:
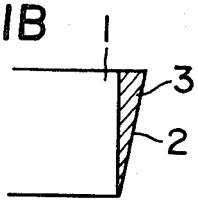
Figure 1C:
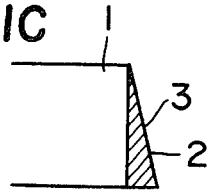
Figure 2:
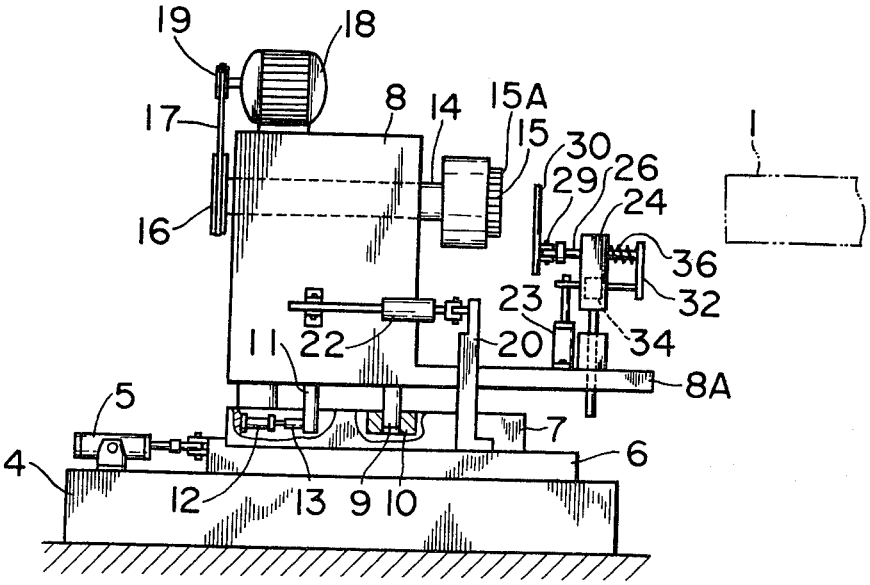
FIG. 2 is a front view showing an embodiment of the conditioning machine for brushing the end face of a metal material according to the present invention.
Figure 3:
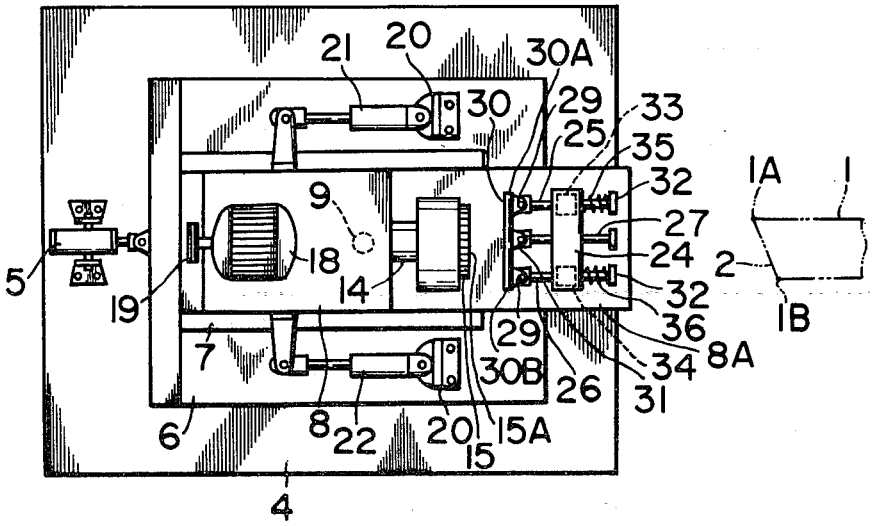
FIG. 3 is a plan view thereof.

FIGS. 2 and 3 are explanatory views showing an embodiment of the conditioning machine for brushing an end face of a metal material according to the present invention. Supported on the upper surface of a framework 4 in a trunnion-like manner is a cut-in cylinder 5, and connected to the forward end of a piston rod of said cut-in cylinder 5 is the rear end of a cut-in slider 6 coupled into a dovetail groove notched on the upper surface of the framework 4 and slindably seated therein, to thereby form a cut-in mechanism. Notched on the upper surface of said cut-in slider 6 in the longitudinal direction is a dovetail groove, into which is coupled a swing base 7 slidable in the longitudinal direction. Provided on the swing base 7 is a brushing mechanism 8. A swing shaft 9 projected from the undersurface of said brushing mechanism 8 is rotatably supported by a bearing portion 10 provided on the swing base 7, so that the brushing mechanism 8 can swing about the swing shaft 9. Furthermore, projectingly provided at the other portion of the undersurface of the brushing mechanism 8 is a locking shaft 11. A wedge 13 longitudinally movable by means of a lock cylinder 12 incorporated in the swing base 7 is engaged with an engageable hole formed in the locking shaft 11, so that the brushing mechanism 8, which has swinged to a desirable position, can be fixed on the swing base 7.

Said brushing mechanism 8 has a rotary shaft 14 penetrating therethrough in the longitudinal direction. Fixed on and held by the forward end of said rotary shaft 14 is a brushing tool 15 such as a brush or brushed which form a brushing surface 15A. Fixed on the rear end of the rotary shaft 14 is a pulley 16 which is connected to a pulley 19 fixed on an output shaft of an electric motor 18 thrugh a belt 17.

Furthermore, a pair of brackets 20 are erected at opposite sides of the cut-in slider 6. Rotatably secured to the upper portions of said brackets 20are copying cylinders 21, 22, respectively. Said copying cylinders 21, 22 are relatively rotatably connected at the forward ends of piston rods thereof to opposite portions of the brushing mechanism 8, respectively.

In addition, in elevating cylinder 23 constituting an angle detecting mechanism is provided on an apron 8A forwardly extending from the lower end portion of the brushing mechanism 8, a bearing box 24 is connected to the forward end of a piston rod of said elevating cylinder 23, and said bearing box 24 is vertically raised or lowered through the action of the elevating cylinder 23.

Figure 4:
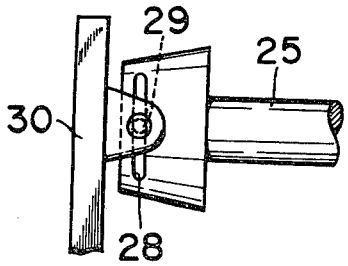
FIG. 4 is an enlarged plan view showing the essential portions thereof.

Longitudinally movably supported at opposite sides of the upper portion of the bearing box 24 are slide shafts 25, 26, and also longitudinally movably supported at the center of the upper portion of the bearing box 24 is a slide shaft 27. Provided at the rear end portions of the right and left slide shafts 25, 26 are slots 28 whose longitudinal directions are perpendicular to the axes of the slide shafts 25, 26 as shown in FIG. 4. Said slots 28 are connected through pins 29 to the right and left opposite end portions of a contact plate 30, and the central portion of said contact plate 30 is connected through a pin 31 to a cylindrical hole of an ordinary form formed at the rear end portion of the central slide shaft 27, and consequently, said contact plate 30 can turn about the connecting pin 31 which connects the contact plate 30 to the central slide shaft 27. In addition, the front surface of said contact plate 30 forms a surface in parallel to a brushing surface 15A of thebrushing mechanism 8, and the position where said contact plate 30 is elevated or lowered through the action of the elevating cylinder 23 is preset at an intermediate portion between the sheet pile 1 fixed and held at the brushing position and the brushing surface 15A of the brushing mechanism 8.

Furthermore, the right and left slide shafts 25, 26 are connected at the forward ends thereof through connecting plates 32 to three-position type stylus valves 33, 34 longitudinally incorporated in the bearing box 24, respectively, and given a forwardly righting moment by compression springs 35, 36 confined between the bearing box 24 and the connecting plates 32. More specifically, the right and left slide shafts 25, 26 are made longitudinally movable by a rearwardly urging force due to the abutment of contact plate 30 against the end face 2 to be brushed of a sheet pile 1 and the forwardly righting moment due to the compressive deformations of the compression springs 35, 36. The longitudinal movement of said slide shafts 25, 26 can actuate the stylus valves 33, 34 through the connecting plates 32.

Figure 5:
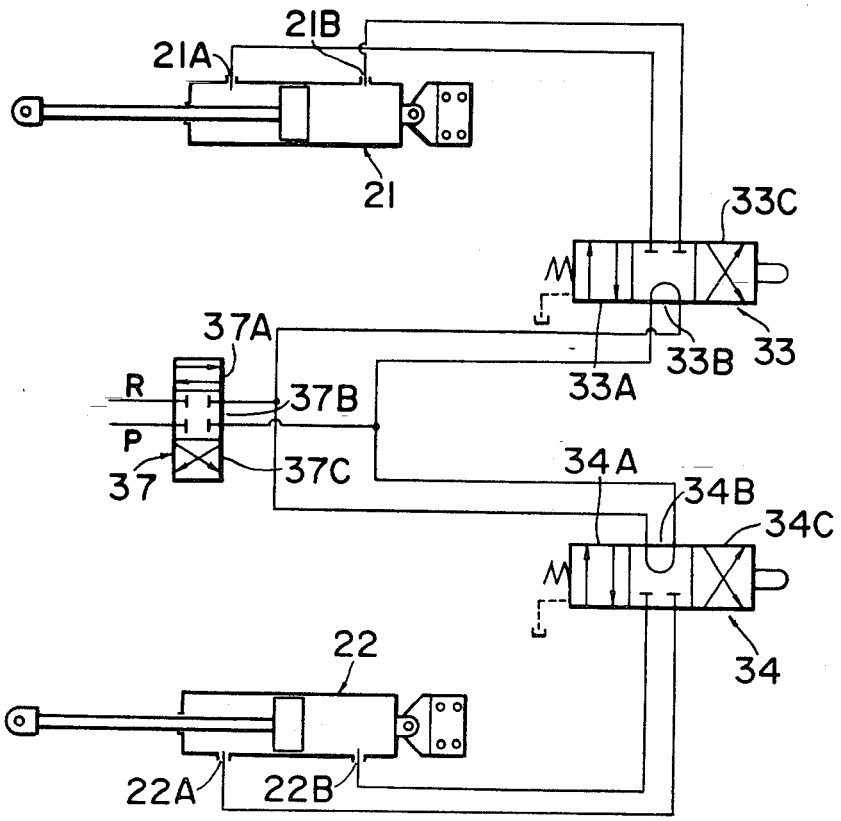
FIG. 5 is a circuit diagram showing the hydraulic circuit thereof.

FIG. 5 is an explanatory view showing a hydraulic (or pneumatic) system including a main change-over valve 37, stylus valves 33, 34, copying cylinders 21, 22. Here, said main change-over valve 37 is connected to a piping P on the pump side and a piping on the return side, and may be changed over to three positions including a copying position 37A, intermediate position 37B and restoring position 37 C by the electromagnetic operation. Furthermore, the stylus valves 33, 34 may be changed over by the movement of said right and left slide shafts 25, 26 between original positions 33A, 34A, the intermediate portions 33B, 34B and the reversing positions 33C, 34C. Additionally, the copying cylinders 21, 22 are provided therein with ports 21A, 22A at the advancing sides thereof and ports 21B, 22B at the retracting sides thereof.

More specifically, in the hydraulic circuit as shown in FIG. 5, when the main change-over valve 37 is set at a copying position 37A and the stylus valves 33, 34 are set at the original positions 33A, 34A oil umder pressure from a pump flows into the copying cylinders 21, 22 through the ports 21A, 22A at the advancing sides, thus making the brushing mechanism 8 advanceable. Furthermore, in the case the main change-over valve 37 is set at the copying position 37A, if the stylus valves 33, 34 are changed over to the intermediate positions 33B, 34B, the oil under pressure from the pump side does not flow into the copying cylinders 21, 22, thus stopping the brushing mechanism 8. Further, in the case the main change-over valve 37 is set at the copying position 37A, if the stylus valves 33, 34 are changed over to the reversing positions 33C, 34C, the oil under pressure from the pump side flows into the copying cylinder 21, 22 through the ports 21B, 22B at the retracting sides, thus making the brushing mechanism retractable. Furthermore, in the case the main change-over valve 37 is set at the restoring position 37C, if the stylus valves 33, 34 are changed over to the original positions 33A, 34A, the oil under pressure from the pump flows into the copying cylinders 21, 22 through the ports 21B, 22B at the retracting sides, thus making the brushing mechanism 8 retractable in the direction of the original position.

Description will hereunder be given of action of the abovedescribed embodiment. When the sheet pile 1 is transversely transported and fixed at a widthwise central position of the framework 4 as indicated by two-dot chain lines in FIGS. 2 and 3 by clamp means, not shown, the elevating cylinder 23 is driven, whereby the contact plate 30 of the angle detecting mechanism is elevated and stopped at a position of height where the contact plate 30 can be brought into abutting contact with the end face 2 of the sheet pile 1 to be brushed. Next, the main change-over valve 37 constituting the linear move driving means is changed from the intermediate position 37B over to the copying position 37A, through the agency of the compression springs 35, 36 the oil under pressure passing through the ports of the stylus valves 33, 34 disposed at the original positions 33A, 34A is fed to the ports 21A, 22A at the advancing sides of the copying cylinders 21, 22, the right and left copying cylinders 21, 22 are driven at the same speed, and the contact plate 30 of the angle detecting mechanism together with the swing base 7 and the brushing mechanism 8 are advanced to the end face 2 of the metal material to be brushed. Here, the wedge 13 of the lock cylinder 12 is disengaged from the locking shaft 11.

When the brushing mechanism 8 advanced and the upper end of the sheet pile 1 in FIG. 3 is brought into contact with the upper end of the contact plate in FIG. 3, the slide shaft 25 and the upper end 30A of the contact plate 30 are urged rearwardly against a biasing force of the compression spring 35. Along with said rearward movement of said slide shaft 25, a rod of the stylus valve 33 connected through the connecting plate 32 to said slide shaft 25 is moved rearwardly, whereby the stylus valve 33 is changed from the original position 33A over to the intermediate position 33B. As the stylus valve 33 approaches the intermediate position 33B as described above, the quantity of the oil under pressure flowing into said stylus valve 33 is decreased, and simultaneously, the quantity of the oil under pressure flowing into the port 21A at the advancing side of the copying cylinder 21 from said stylus valve 33 through the hydraulic circuit is decreased, and consequently, the advancing speed of the copying cylinder 21 to the right in FIG. 5 becomes progressively slow to come to stop finally. (In this case, when the upper end 30A of the contact plate 30 is urged further rearwardly, the forward end of the rod of the stylus valve 33 finally reaches the reversing position 33C and the oil under pressure flows into the port 21B at the retracting side of the copying cylinder 21, whereby the copying cylinder 21 is retracted. In other words, a function of safety device is executed at the time of excessive movement of the copying cylinder 21). At this time, the lower end 30B of the contact plate 30 in FIG. 3 is in a condition of not abutting against the lower end 1B of the end face 2 to be brushed in FIG. 3, and consequently, the copying cylinder 22 continues to advance at the original speed. Namely, the brushing mechanism 8 is swinged about the swing shaft 9 of the swing base 7 by a rotary moment acting in the counterclockwise direction in FIG. 3 based on the difference in relative speed between the copying cylinders 21, 22.

By said swing of the brushing mechanism 8, the upper end 30A of the contact plate 30 is separated from the upper end 1A of the end face 2 of the metal material 1 to be brushed, and then, the upper end 30A of the contact plate 30 thus separated advances the rod of the stylus valve 33 by the biasing force of the compression spring 35, whereby the stylus valve 33 is changed from the intermediate position 33B over to the original position 33A.

As the oil under pressure flowing into the port 21A at the advancing side of the copying cylinder 21 is progressively increased in quantity due to the change-over of the stylus valve 33, the copying cylinder 21 is progressively increased in speed in the advancing direction, and the brushing mechanism 8 is moved forwardly in a condition of being slightly tilted from the upper left to the lower right (swinged condition) in FIG. 3.

Both copying cylinders 21, 22 further continue advancing, the lower end 30B of the contact plate 30 is brought into abutting contact with the lower end 1B of the end face 2 of the metal material to be brushed, whereby the stylus valve 34 is changed from the original position 34A over to the intermediate position 34B, with the result that the oil under pressure flowing into the port 22A at the advancing side of the copying cylinder 22 is decreased in quantity, whereby the copying cylinder 22 is progressively decreased in advancing speed to come to a stop finally. (In addition, when the copying cylinder has been excessively moved, the stylus valve 34 reaches the reversing position 34C and makes retracting movement for safety's sake). Prior to said stop action, the upper end 30A of the contact plate 30 is brought into abutting contact with the upper end 1A of the end face 2 of the sheet pile 1 to be brushed in the same manner as above, and the same action as above are repeated. Furthermore, prior to the stop of the copying cylinder 21 in advance, the lower end 30B of the contact plate 30 is brought into abutting contact with the lower end 1B of the end face of the sheet pile 1 to be brushed, the values of displacement of the ends 30A, 30B of the contact plate 30 in advancing or retracting movement are progressively decreased, and finally, the end face 2 to be brushed of the sheet pile 1 (line A–1B) and the contact plate (line 30A–30B) come into parallel to each other. In this parallel condition, the stylus valves 33, 34 are located at the intermediate positions 33B, 34B, the speeds, at which both stylus valves move, become zero (0), the contact plate 30 is not pulled through the contact plate 32, both the copying cylinders 21, 22 are stopped, and the contact plate 30, i.e., the end face 2 of the sheet pile 1 to be brushed and the brushing surface of the brushing tool 15 come into parallel to each other, thereby completing the copying work.

The completion of the copying work is sensed by that both limit switches $LS_1$, $LS_2$ set at the intermediate positions 33B, 34B of the stylus valves 33, 34 at opposite sides of the bearing box 24 are simultaneously turned on. Emission of a signal of sensing the completion of the copying work actuates the lock cylinder 12, whereby the brushing mechanism 8 is fixed on the swing base with the wedge 13 being engaged with the locking shaft 11. Simultaneously with this, the cut-in slider 6 and the swing base 7 are locked through the action of a lock mechanism, not shown, an output of said locking signal causes the main change-over valve 37 is changed over to the intermediate position 37B, whereby the feed of the oil under pressure from the pump to the stylus valves 33, 34 is interrupted.

Further, an output of a lock sensing signal to the swing base 7 of said brushing mechanism 8 actuates the elevating cylinder 23 to lower the contact plate 30. By this, the contact plate 30 is lowered to a position lower than the lower end of the end face 2 of the sheet pile 1 to be brushed. Until the contact plate 30 is lowered as described above, the contact plate 30 is in abutting contact with the end face 2 of the metal material to be brushed, whereby the stylus valves 33, 34 are stopped at the intermediate positions 33B, 34B. However, after the contact plate 30 is lowered, the stylus valves 33, 34 are restored to the original positions 33A, 34A by the biasing forces of the compression springs 35, 36. In this restored conditions, the main change-over valve 37 has been changed over to the intermediate position 37B, and consequently, the copying cylinders 21, 22 do not operate.

When the completion of the lowering of the contact plate 30 is sensed by the limit switch, the resulting lowering sensing signal causes the cut-in cylinder 5 to advance by a predetermined value of cut-in, and the cut-in slider 6 advances the swing base 7 and the brushing mechanism 8, which are locked to the upper surface thereof. Along with the advance of the brushing mechanism 8, the brushing tool 15 driven by the electric motor 18 brushs the end face 2 of the sheet pile 1 to be brushed by a required period of time preset by a timer.

Upon the completion of brushing the sheet pile 1 by the brushing tool 15, a brushing timeup signal causes the cut-in cylinder 5 to be retracted to the original position. When the completion of the retracting movement of said cut-in cylinder 5 is sensed by a limit switch, the lock cylinder is actuated to release the engagement of the locking shaft 11 with the wedge 13, whereby the brushing mechanism 8 and the swing base 7 are unlocked from each other. Furthermore, simultaneously with this, the cut-in slider 6 and the swing base 7 are unlocked from each other through the action of a lock mechanism, not shown. When the release of the brushing mechanism 8 from the swing base 7 is sensed by a limit switch, the main change-over valve 37 is changed over to the restoring position 37C, the oil under pressure from the pump flows into the ports 21B, 22B at the retracting sides of the copying cylinders 21, 22 through the original positions 33A, 34A of the stylus valves 33, 34, the copying cylinders 21, 22 are retracted, and the brushing mechanism 8 is restored to the original position on the swing base 7. When the completion of the retracting movement of the copying cylinders 21, 22 is sensed by a limit switch, the sheet pile 1 whose end face 2 has been brushed is unlocked and carried out, and the contact plate 30 is elevated through the action of the elevating cylinder 23. Further, a succeeding sheet pile 1 to be brushed is conveyed to a predetermined position by a conveyor and locked thereat, a lock sensing signal for sensing the lock of said sheet pile 1 changes the main change-over valve 37 over to the copying position, and the brushing work on the succeeding sheet pile 1 is effected by successively repeating the abovedescribed actions.

In the abovedescribed embodiment, the copying cylinders 21, 22 render shock-absorbing properties to the contact plate 30 and smoothly give a turning moment to the brushing mechanism 8, and consequently, the contact resistance between the contact plate 30 and the end face 2 of the sheet pile 1 to be brushed is low, whereby the brushing mechanism 8 is allowed to operate without receiving mechanical damages, so that the brushing surface 15A of the brushing tool 15 can be reliably and readily brought into parallel to the end face 2 of the metal material 1 to be brushed. Furthermore, even if there are variations in the position of the sheet pile 1 to be brushed within the strokes of the copying cylinders 21, 22, the copying is possible, namely, the brushing tool 15 and the end face 2 to be brushed are coincided in position. Consequently, such advantages can be offered that the predetermined cut-in value of the cut-in cylinder 5 is not affected by the variations of the end face 2 to be brushed in position and always constant, so that the brushing can be effected without requiring to adjust the predetermined value of cut-in in accordance with the specific variation. Furthermore, as described above, the completion of the copying work can be automatically sensed by the limit switch to move to the brushing work, so that the brushing can be effected in a condition of uniformizing the value of cut-in without requiring the operator's skill. Further, the stylus valves 33, 34 are each provided with a safety hydraulic circuit giving the shock-absorbing properties to the contact plate 30, and consequently the contact plate 30, brushing tool 15 and the like do not given a strong urge to the end face 2 of the metal material to be brushed, which would otherwise cause damages to the brushing machine itself.

Figure 6A:
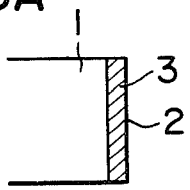
FIGS. 6A, 6B and 6C are enlarged views of the essential portions showing the operating conditions of the brushing tool in said embodiment, respectively.
Figure 6B:
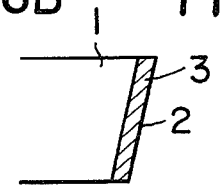
Figure 6C:
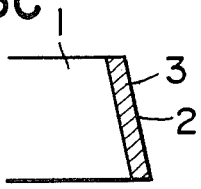

In addition, FIGS. 6A to 6C are explanatory views showing the results of brushing in the abovedescribed embodiment, in which FIG. 6A shows the case where the end face 2 of the metal material to be brushed is cut perpendicularly to the longitudinal direction, and FIGS. 6B and 6C show the cases where said end faces 2 are cut in inclined directions different from each other. Said results of brushing indicate that the brushed-off portions 3 shown by crossed oblique lines always form parallelogrammatical shapes, whereby the values of cut-in are small, so that the yield of the sheet pile 1 can be improved, thus making the finished surface uniform and beautiful. Furthermore, the values of cut-in are low, so that the brushing efficiency can be improved. Further, the entire area of the brushing surface 15A of the brushing tool 15 is brought into abutting contact with the end face 2 of the sheet pile 1 to be brushed always in the same condition, whereby no excessive force acts on the brushing surface 15A, so that the brushing tool 15 can be driven for rotation by a driving force lower than that in the cases of the prior art, thus enabling to extend the service life of the brushing tool 15.

Figure 7:
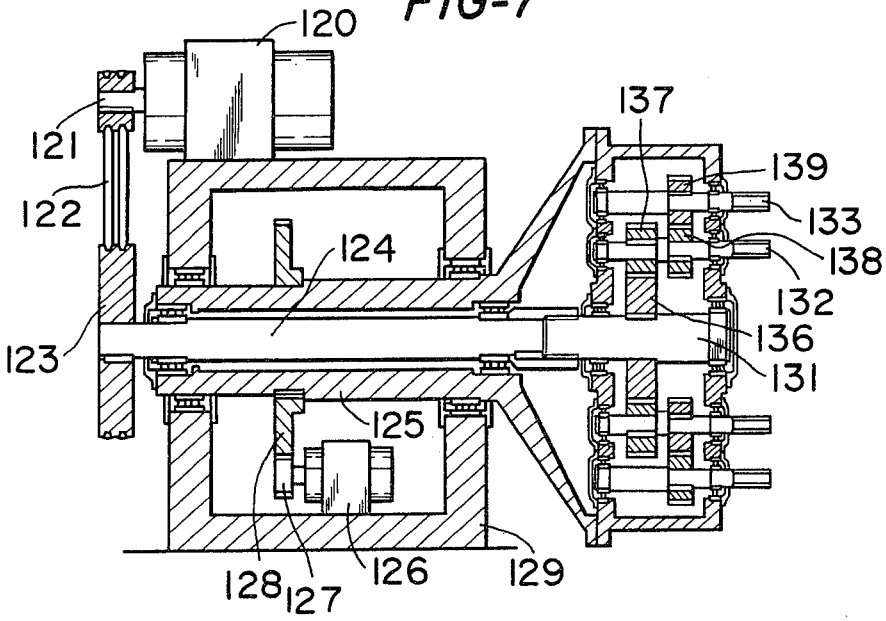
FIG. 7 is a sectional view showing a modification of the brushing mechanism.
Figure 8:
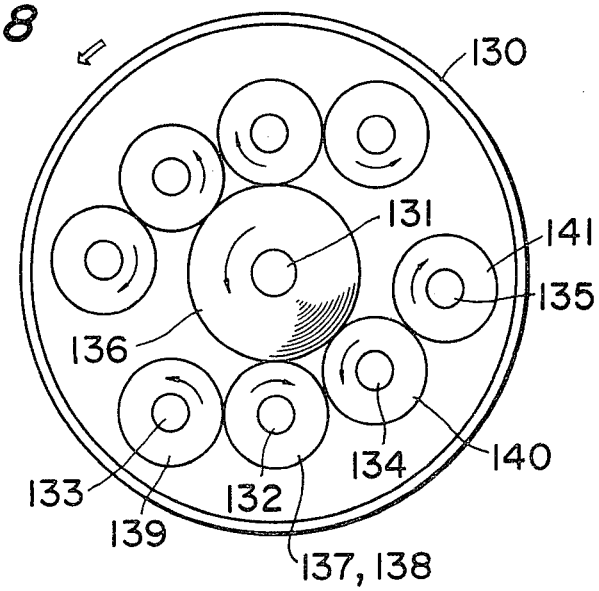
FIG. 8 is a front view of FIG. 7.

FIGS. 7 and 8 are explanatory views a modification of the brushing mechanism in the conditioning machine for brushing the end face of metal material according to the present invention.

A motor 120 is one for use in a bicycle and rotates a shaft 124 through a pulley 121, a V-belt 122 and a pulley 123.

The shaft 124 is rotatably supported by a shaft 125 through a bearing.

A motor 126 is a motor for the revolution along a predetermined path and rotates a gears 127 and 128. The gear 128 is fixed on the shaft 125 which is rotated.

A casing 130 is solidly secured to the shaft 125 by bolts and nuts. The motor 126 is driven to rotate the casing 130.

Rotatably supported by the casing 130 through a bearing is a shaft 131, to which the shaft 124 is connected by threaded coupling.

Shafts 132, 133, 134 and 135 are also rotatably supported by the casing 130 through bearings. A gear 136 is mounted on the shaft 131, gears 137 and 138 are mounted on the shaft 132, and the gears 136 and 137 are meshed with each other.

Mounted on the shaft 133 is a gear 139 which is meshed with the gear 138. Mounted on the shaft 134 is a gear 140 which is meshed with the gear 138. Mounted on the shaft 135 is a gear 141 which is meshed with the gear 140.

In operation, rotation of the motor 120 causes the shaft 131 to rotate, whereby a pair of the shaft 132 and 135 rotate in the same direction, and a pair of the shafts 133 and 134 rotate also in the same direction, but the former pair and the latter pair rotate in directions opposite to each other. If the casing 130 is rotated by the motor 126, then the respective shafts make planetary movements in which they rotate, and at the same time, revolve along the predetermined paths. Consequently, the end face of the metal material is brushed by brushing tools mounted on the respective shafts. In this embodiment, there is provided a planetary movement type brushing mechanism wherein eight brushing tools are mounted on eight shafts.

It should be apparent to one skilled in the art that the above described embodiment are merely illustrative of but a few of the many possible specific embodiments of the present invention. Numerous and varied other arrangements can be readily devised by those skilled in the art without departing from the spirit and scope of the invention.

What is claimed is:

1. A conditioning machine for brushing an end face of a metal material comprising:

a brushing mechanism having a brushing tool for brushing an end face of a metal material to be brushed;

an angle detecting mechanism having a side surface in parallel to a brushing surface of the brushing tool of said brushing mechanism, provided in such a manner as to be movable into and out of a space formed between the end face of a metal material to be brushed and the brushing surface of the brushing mechanism, and being capable of abutting against the end face of a metal material to be brushed to detect an inclination of the end face to be brushed;

a frame mechanism having rested thereon said brushing mechanism and said angle detecting mechanism, being swingable or fixable with respect to a base; and a copying mechanism for causing said frame mechanism to follow the inclination of the end face to be brushed and be swinged, when said angle detecting mechanism abuts against the end face to be brushed, whereby the brushing surface of the brushing tool of the brushing mechanism is brought into parallel to the end face of a metal material to be brushed.

2. A conditioning machine for brushing an end face of a metal material as set forth in claim 1, wherein, in said brushing mechanism, only the brushing tool, which is separated from the frame mechanism, is linearly movable toward and away from the end face to be brushed.

3. A conditioning machine for brushing an end face of a metal material as set forth in claim 1, wherein, in said brushing mechanism, a brushing tool are mounted on each of the plurality of shafts making planetary movements.

4. A conditioning machine for brushing an end face of a metal material as set forth in claim 1, wherein, said frame mechanism incorporates means for fixing itself to the base through a wedge type engagement.

5. A conditioning machine for brushing an end face of a metal material as set forth in claim 1, wherein said frame mechanism comprises a swing base for swinging and fixably holding said brushing mechanism and a cut-in mechanism for linearly moving and fixing said swing base.

6. A conditioning machine for brushing an end face of a metal material as set forth in claim 1, wherein said copying mechanism is adapted to swing the brushing mechanism commensurate to a value of displacement in abutting obtained through a hydraulic circuit for transmitting the value of displacement in abutting said angle detecting mechanism against the end face to be brushed.

* * * * *